US011569610B2

(12) United States Patent
Nakamura et al.

(10) Patent No.: US 11,569,610 B2
(45) Date of Patent: Jan. 31, 2023

(54) ROTARY CONNECTOR

(71) Applicant: Yazaki Corporation, Tokyo (JP)

(72) Inventors: Masatoshi Nakamura, Shizuoka (JP); Akihiro Tsuruta, Shizuoka (JP); Nobuyuki Mukoujima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 470 days.

(21) Appl. No.: 16/847,887

(22) Filed: Apr. 14, 2020

(65) Prior Publication Data

US 2020/0325941 A1 Oct. 15, 2020

(30) Foreign Application Priority Data

Apr. 15, 2019 (JP) ..... JP2019-076853

(51) Int. Cl.
*H01R 13/625* (2006.01)

(52) U.S. Cl.
CPC ..... *H01R 13/625* (2013.01)

(58) Field of Classification Search
CPC ..... H01R 13/625
See application file for complete search history.

(56) References Cited

U.S. PATENT DOCUMENTS 4,741,706 A * 5/1988 Takeda ..... H01R 13/623 439/321
5,403,198 A * 4/1995 Koganemaru ..... G08B 17/113 439/333
5,505,632 A * 4/1996 Hayashi ..... H01R 13/625 439/318
5,980,293 A * 11/1999 Nagano ..... H01R 13/623 439/318
6,280,221 B1 8/2001 Fukase et al.
6,297,741 B1 * 10/2001 Higgins ..... F16B 7/20 439/337
6,368,133 B1 * 4/2002 Zeiler ..... H01R 13/625 439/321
6,811,423 B2 * 11/2004 Yoshigi ..... H01R 13/641 439/318
7,077,677 B2 * 7/2006 Sanuki ..... H01R 13/623 439/321
7,455,543 B2 11/2008 Natter et al.
9,093,783 B2 * 7/2015 Grimm ..... H01R 24/005
2020/0325941 A1 * 10/2020 Nakamura ..... H01R 13/641

FOREIGN PATENT DOCUMENTS

JP 2005-267930 A 9/2005
JP 2009-505343 A 2/2009

* cited by examiner

*Primary Examiner* — Neil Abrams
(74) *Attorney, Agent, or Firm* — Sughrue Mion, PLLC

(57) ABSTRACT

A rotary connector includes: a first housing; a second housing; a bayonet ring including a locked portion to be locked to a locking portion of the first housing, which forms a bonded state by rotating by a predetermined angle in a ready state, so that its rotation is prevented; and a connector position assurance that is prevented from moving from a first position in the ready state, and in the bonded state, that is moveable to a second position and maintains a state in which the locked portion is locked to the locking portion.

5 Claims, 12 Drawing Sheets

FRONT ⟷ REAR

ROTARY CONNECTOR

CROSS-REFERENCE TO RELATED APPLICATIONS

The present application is based on, and claims priority from Japanese Patent Application No. 2019-076853, filed on Apr. 15, 2019, the entire contents of which are incorporated herein by reference.

TECHNICAL FIELD

The present disclosure relates to a rotary connector, and more particularly, to a rotary connector having a connector position assurance (CPA).

BACKGROUND

As a rotation fitting connector (rotary connector) of a first known example, one including a male connector, a female connector, and a meshing ring (bayonet ring) is known (see JP 2005-267930 A).

In the rotary connector of the first known example, a temporary locking projection and a detection locking projected portion are provided on the outer peripheral wall portion of the male connector.

In the rotary connector of the first known example, an axial wall portion that engages with the temporary locking projection and a flexible locking arm having, on an inner surface of its tip, a locking claw that engages with the detection locking projected portion are provided on an outer surface of the meshing ring.

In the rotary connector of the first known example, a contact surface that contacts the flexible locking arm is formed at the projected tip of the detection locking projected portion, and a step portion having a contacted surface that contacts the contact surface is formed in the flexible locking arm.

And, the completely fitted state between the male connector and the female connector can also be recognized visually and aurally, in addition to the rotation feeing of the meshing ring, whereby the reliability of the fitting between the male connector and the female connector is improved.

Also, as a rotation fitting connector (rotary connector) of a second known example, one including a lock key (CPA: connector position assurance), in addition to the male connector, the female connector, and the bayonet ring, is known (see JP 2009-505343 A).

SUMMARY

In the rotary connector of the second known example, it is important that the CPA is made operable when the bonding between the male connector and the female connector is completed by rotating the bayonet ring, so that the bonded state between the male connector and the female connector is assured by activating the CPA.

An object of the present disclosure is to provide, in a rotary connector including a female connector (first connector), a male connector (second connector), a bayonet ring, and a lock key (CPA: connector position assurance), what assures the bonded state between the male connector and the female connector with the CPA activated only when the bonding is completed by rotating the bayonet ring.

A rotary connector according to an embodiment includes: a first housing; a second housing that is fixed to the first housing; a locking portion formed in at least one of the first housing and the second housing; a bayonet ring including a locked portion to be locked to the locking portion, the bayonet ring configured to form, in a ready state of engaging with the first housing and the second housing, a bonded state in which the second housing is bonded to the first housing by rotating by a predetermined angle with respect to the first housing, and configured to be prevented, in the bonded state, from rotating with respect to the first housing with the locked portion locked to the locking portion; a contact portion formed on the bayonet ring; and a connector position assurance including a contacted portion to contact the contact portion, and capable of engaging with the bayonet ring, in the ready state, the connector position assurance located at a first position and prevented from moving from the first position with the contacted portion contacting the contact portion, in the bonded state, the connector position assurance capable of moving from the first position to a second position with the contacted portion moving away from the contact portion, and when being located at the second position, the connector position assurance maintaining the state in which the locked portion is locked to the locking portion.

According to the above configuration, in the rotary connector having the first housing, the second housing, the bayonet ring, and the connector position assurance, the connector position assurance is activated only when the bonding is completed by rotating the bayonet ring, whereby the effect that the bonded state between the first housing and the second housing can be assured by the connector position assurance is obtained.

DETAILED DESCRIPTION

Various embodiments will be described hereinafter with reference to the accompanying drawings.

First Embodiment

Figure 1:
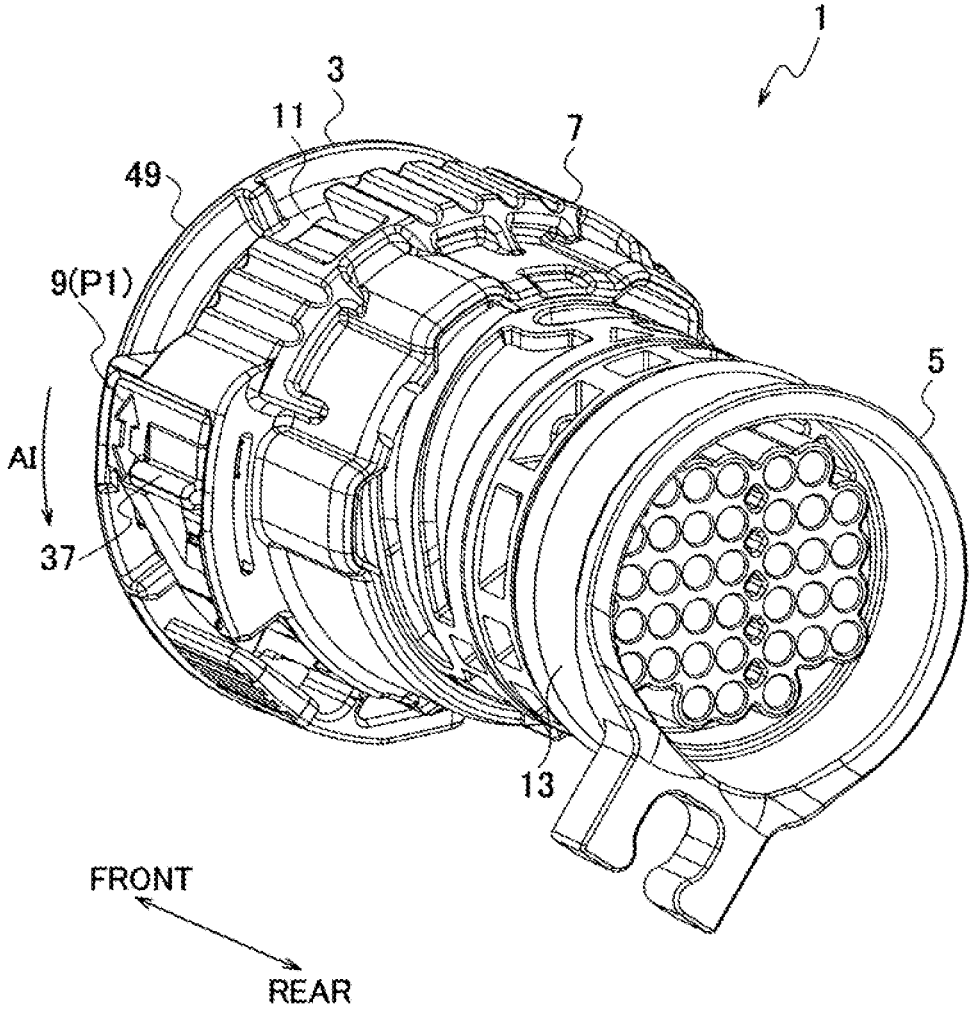
FIG. 1 is a perspective view of a rotary connector according to a first embodiment.
Figure 2:
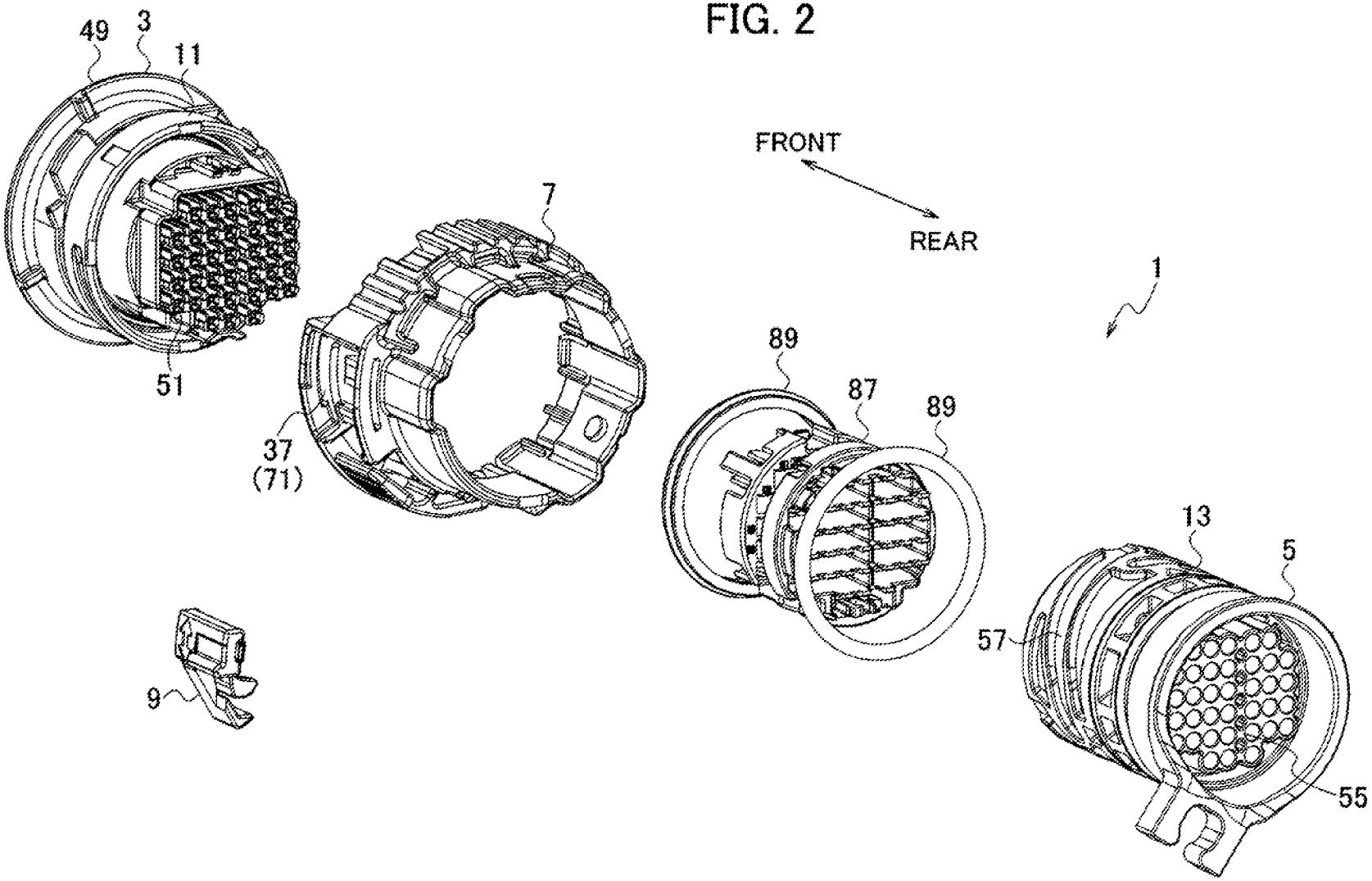
FIG. 2 is an exploded perspective view of the rotary connector according to the first embodiment.

A rotary connector (rotation fitting connector) 1 according to a first embodiment is one in which connectors are bonded together by using a bayonet ring 7 and the bonded state between the connectors is assured by using a connector position assurance 9, and the rotary connector 1 includes a first housing (e.g., a female housing) 3 as a first connector, a second housing (e.g., a male housing) 5 as a second connector, the bayonet ring (meshing ring) 7, and the connector position assurance (CPA) 9, as illustrated in FIGS. 1 and 2.

Herein, for convenience of description, a predetermined direction is defined as the front-rear direction. Additionally, each of the first housing 3, the second housing 5, the bayonet ring 7, and the connector position assurance (housing position assurance) 9 is made of, for example, an insulating synthetic resin, and is integrally molded.

Figure 3:
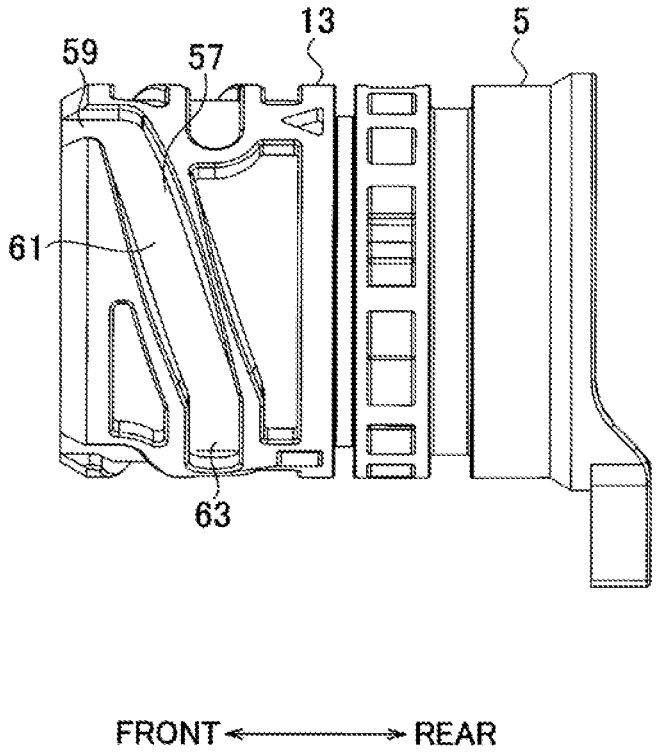
FIG. 3 is a side view of a male housing of the rotary connector according to the first embodiment.
Figure 6:
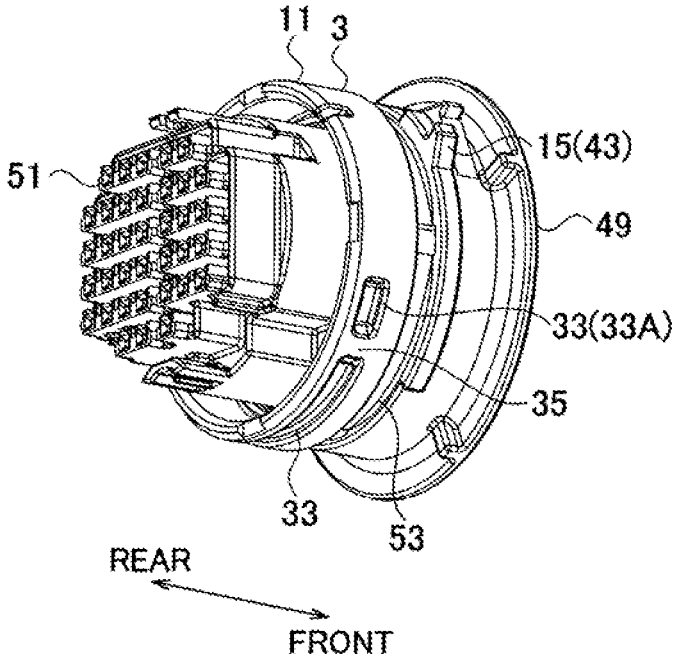
FIG. 6 is a perspective view of a female housing of the rotary connector according to the first embodiment.

The first housing 3 includes a first housing main body 11, as illustrated in FIG. 6 and the like. The second housing 5 is configured to be fixed to the first housing 3, and includes a second housing main body 13, as illustrated in FIG. 3 and the like.

The bayonet ring 7 includes a bayonet ring main body 19 and a locked portion 17 to be locked to a locking portion 15 (see FIG. 6) formed in the first housing 3 (first housing main body 11), as illustrated in FIGS. 4A to 4C, 5, and the like. The locking portion 15 may be formed in the second housing 5, or may be formed in at least one of the first housing 3 and the second housing 5.

The bayonet ring 7 is configured to engage with the first housing 3 and the second housing 5. While engaging with the first housing 3 and the second housing 5, the bayonet ring 7 is movable in a predetermined manner with respect to the first housing 3 and the second housing 5.

With the bayonet ring 7 rotating by a predetermined angle in the direction indicated by an arrow A1 in FIG. 1 with respect to the first housing 3 (second housing 5) in a ready state in which the bayonet ring 7 engages with the first housing 3 and the second housing 5 (see FIGS. 1, 8, 9, and 11), a bonded state in which the second housing 5 is bonded to the first housing 3 (see FIG. 10A) is formed.

Figure 10A:
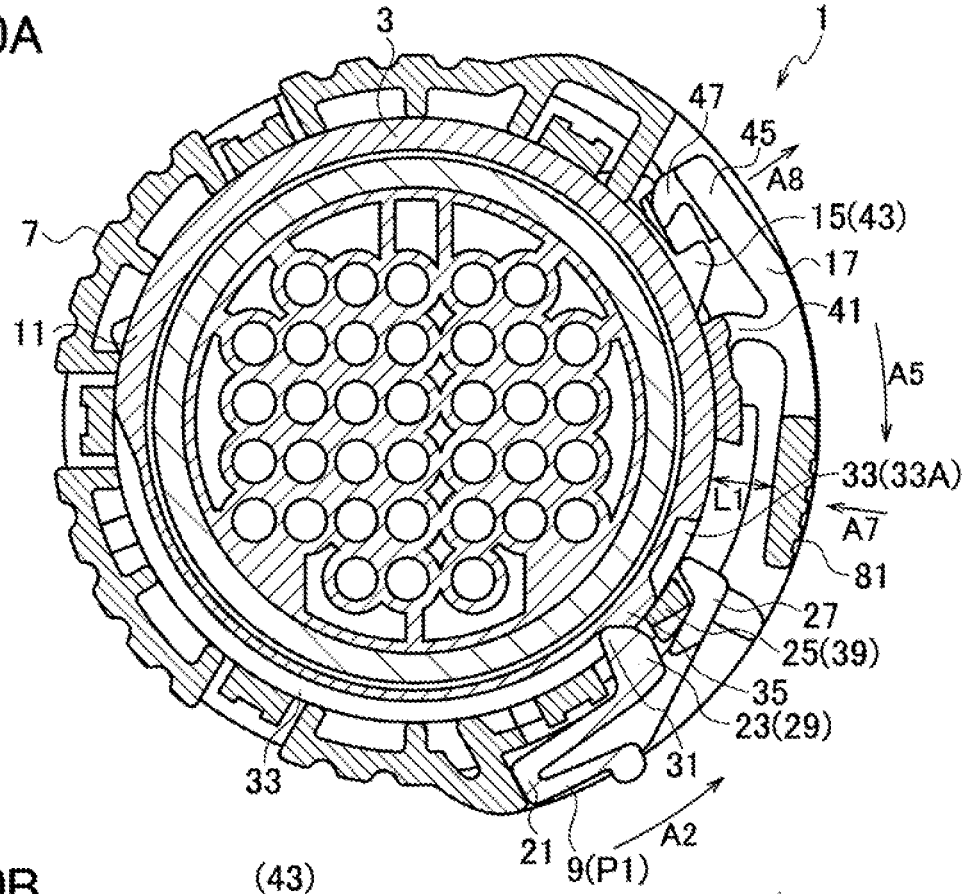
FIG. 10A is a cross-sectional view illustrating a state in which the connector position assurance of the rotary connector according to the first embodiment is located at the first position.
Figure 10B:
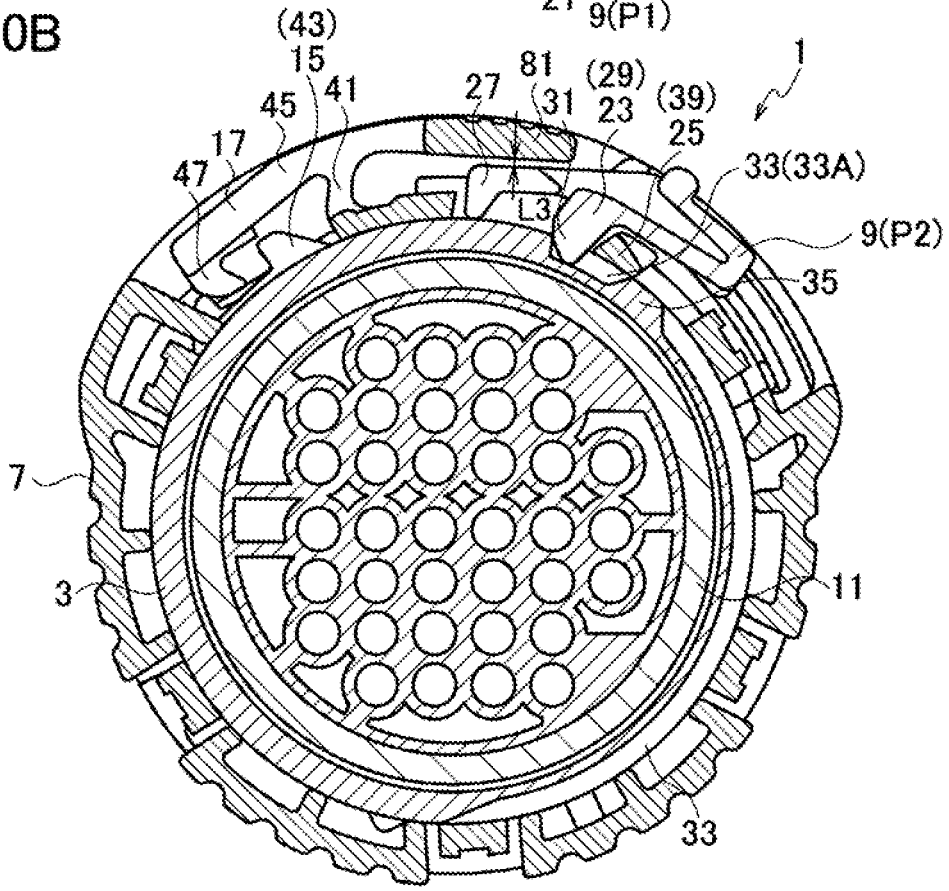
FIG. 10B is a cross-sectional view illustrating a state (completely bonded state) in which the rotary connector according to the embodiment is in a bonded state and the connector position assurance is located at a second position.

In the bonded state, the locked portion 17 is locked to the locking portion 15, as illustrated in FIGS. 10A, 10B, and the like, so that the movement of the bayonet ring 7 with respect to the first housing 3 and the second housing 5 is prevented, whereby the bayonet ring 7, the first housing 3, and the second housing 5 are integrated and the bonded state between the first housing 3 and the second housing 5 is maintained.

In further description, the bayonet ring 7 can rotate in a predetermined direction with respect to the first housing 3, in the above mentioned ready state. When the bayonet ring 7 rotates by a predetermined angle in a predetermined direction from the ready state, the second housing 5 linearly moves in the direction of approaching the first housing 3 (forward direction).

In the ready state, female terminals (not illustrated) fixed in the first housing 3 and male terminals (not illustrated) fixed in the second housing 5 are away from each other.

In the bonded state, the second housing 5 is closest to the first housing 3 and the locked portion 17 is locked to the locking portion 15, whereby the bayonet ring 7 is almost fixed with respect to the first housing 3 and the second housing 5. That is, in the bonded state, the bayonet ring 7 cannot move with respect to the first housing 3 and the second housing 5 except for backlash. So, the bonded state is maintained, which cannot be easily released.

In the bonded state, the female terminals (not illustrated) fixed in the first housing 3 and the male terminals (not illustrated) fixed in the second housing 5 are connected to each other.

The connector position assurance 9 includes an assurance main body 21 and a contacted portion 23. The contacted portion 23 contacts a contact portion 25 provided in the bayonet ring 7 (bayonet ring main body 19).

The connector position assurance 9 engages with the bayonet ring 7 so as to be freely movable with respect to the bayonet ring 7 between a first position P1 (see FIGS. 8 and 9) and a second position P2 (see FIG. 10B).

Figure 11:
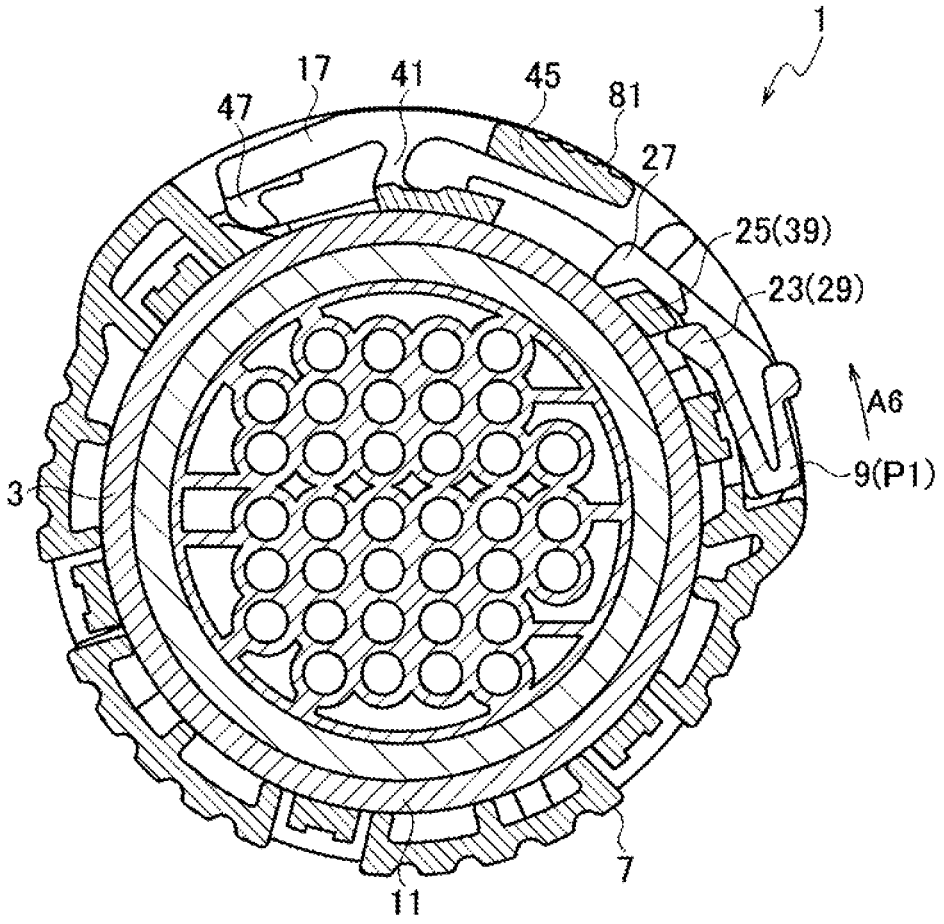
FIG. 11 is a cross-sectional view corresponding to FIG. 9 (a cross-sectional view illustrating another portion), illustrating a state in which the connector position assurance is located at the first position in the ready state.
Figure 12A:
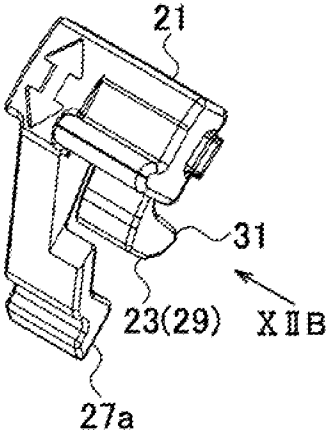
FIG. 12A is a perspective view illustrating a connector position assurance of a rotary connector according to a second embodiment.
Figure 12B:
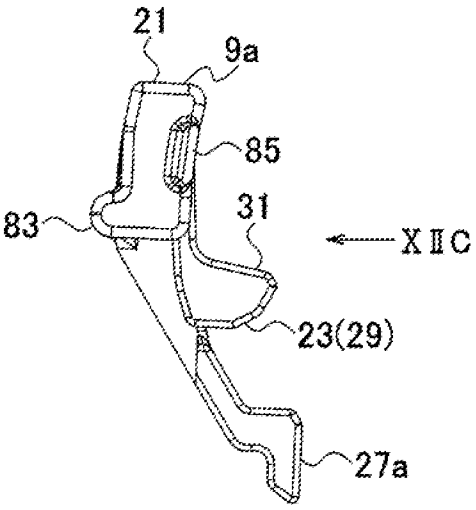
FIG. 12B is a view viewed from the direction of an arrow XIIB in FIG. 12A.
Figure 12C:
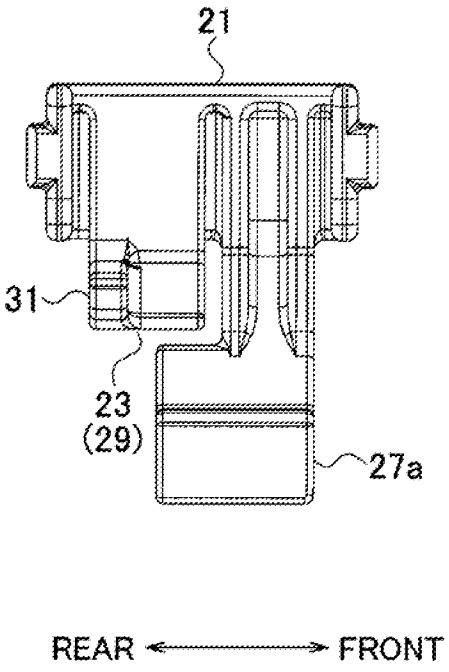
FIG. 12C is a view viewed from the direction of an arrow XIIC in FIG. 12B.

In the ready state, the connector position assurance 9 is located at the first position P1, and is prevented from moving from the first position P1 (being located at the first position P1 is maintained) with the contacted portion 23 contacting the contact portion 25, as illustrated in FIG. 11.

On the other hand, in the bonded state, the contacted portion 23 is away from the contact portion 25 (the contacted portion 23 is in the state of not contacting the contact portion 25), and the connector position assurance 9 is in the state of being movable from the first position P1 to the second position P2 in the direction indicated by an arrow A2 in FIG. 10A.

When the connector position assurance 9 is located at the second position P2, as illustrated in FIG. 10B, the state in which the locked portion 17 is locked to the locking portion 15 is maintained (assured). That is, the state in which the locked portion 17 is locked to the locking portion 15 is prevented from being released, so the bayonet ring 7 does not rotate with respect to the first housing 3 and the second housing 5.

When the bayonet ring 7 is rotated by a predetermined angle with respect to the first housing 3 in the ready state, the connector position assurance 9 located at the first position P1 also rotates integrally with the bayonet ring 7.

Alternatively, a mark, indicating that the connector position assurance 9 is located at the first position P1 or the second position P2, may be provided in the bayonet ring 7. Thereby, the position of the connector position assurance 9 can be easily confirmed visually. For example, it can be easily recognized visually that the connector position assurance 9 is located at the second position P2, so the assurance of the bonded state (completely bonded state) between the first connector (the first housing 3) and the second connector (the second housing 5) can be visually confirmed.

Figure 7A:
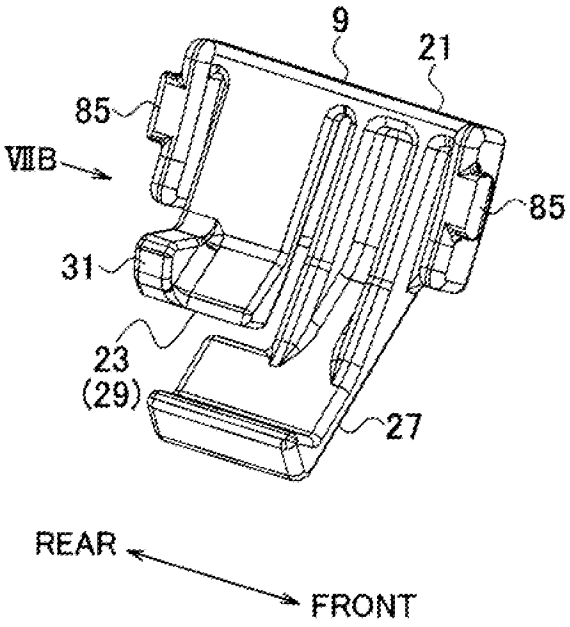
FIG. 7A is a perspective view illustrating a connector position assurance of the rotary connector according to the first embodiment.
Figure 7B:
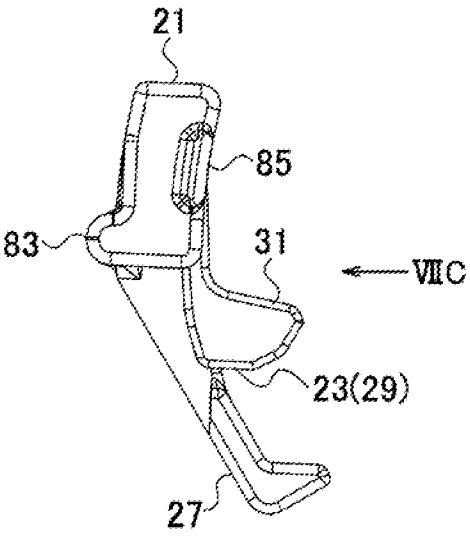
FIG. 7B is a view viewed from the direction of an arrow VIIB in FIG. 7A.
Figure 7C:
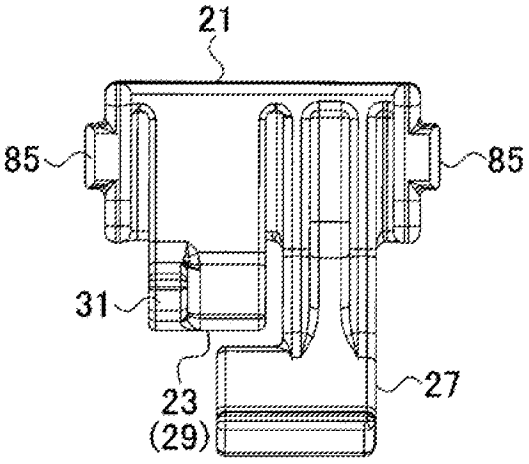
FIG. 7C is a view viewed from the direction of an arrow VIIC in FIG. 7B.

As illustrated in FIGS. 7A to 7C and the like, the connector position assurance 9 includes a first assurance contact portion 27, and a second assurance contact portion 29 and an assurance projected portion 31 that constitute the contacted portion 23, in addition to the assurance main body 21.

The first assurance contact portion 27 projects in a cantilever shape from the assurance main body 21. The second assurance contact portion 29 projects in a cantilever shape from the assurance main body 21 so as to be aligned with the first assurance contact portion 27. The assurance projected portion 31 projects from and at the tip of the second assurance contact portion 29.

The first housing 3 (outline of the first housing main body 11) is formed in a cylindrical shape. In the side surface of the first housing 3 (side surface of the cylinder), there is provided an arc-shaped groove (groove having a predetermined width) 33 that is recessed from the side surface and extends by a predetermined length in the circumferential direction of the side surface of the cylinder (see FIGS. 6, 9, and the like).

The arc-shaped groove 33 is interrupted (by a slight length) at one end in the longitudinal direction (arc extending direction), and the interrupted portion constitutes a non-grooved portion 35.

The bayonet ring 7 (bayonet ring main body 19) is formed in an annular shape. The bayonet ring 7 engages with the first housing 3 and the second housing 5 such that the rear end portion in the front-rear direction of the first housing 3 and the front end portion in the front-rear direction of the second housing 5 enter inside.

As illustrated in FIGS. 4A to 4C, 5, and the like, the bayonet ring 7 includes a connector position assurance support portion 37, and a bayonet ring contact portion 39 constituting the contact portion 25.

The assurance main body 21 of the connector position assurance 9 engages with the connector position assurance support portion 37. The assurance main body 21 (connector position assurance 9), engaging with the connector position assurance support portion 37 and supported by the bayonet ring 7, can move by a predetermined distance in the circumferential direction of the bayonet ring 7.

In the ready state, the assurance projected portion 31 of the connector position assurance 9 enters the arc-shaped groove 33 of the first housing 3, and the second assurance contact portion 29 (contacted portion 23) of the connector position assurance 9 contacts the bayonet ring contact portion 39 (contact portion 25) of the bayonet ring 7, whereby the connector position assurance 9 is prevented from moving from the first position P1 toward the second position P2 (the movement indicated by an arrow A6 in FIG. 11 cannot be performed).

On the other hand, in the bonded state, the assurance projected portion 31 of the connector position assurance 9 contacts the non-grooved portion 35 of the first housing 3, so a state in the middle of making a transition from FIG. 10A to FIG. 10B is produced and the second assurance contact portion 29 is in the state of not contacting the bayonet ring contact portion 39 (the second assurance contact portion 29 moves outside the first housing 3, the second housing 5, and the bayonet ring 7, therefore being away from the bayonet ring contact portion 39), whereby the connector position assurance 9 can move from the first position P1 to the second position P2.

With the connector position assurance 9 located at the second position P2, the first assurance contact portion 27 is located at the locked portion 17, as illustrated in FIG. 10B, whereby the state in which the locked portion 17 is locked to the locking portion 15 is maintained (the completely bonded state, or the state in which the locked portion is locked to the locking portion cannot be released, is assured).

Figure 4C:
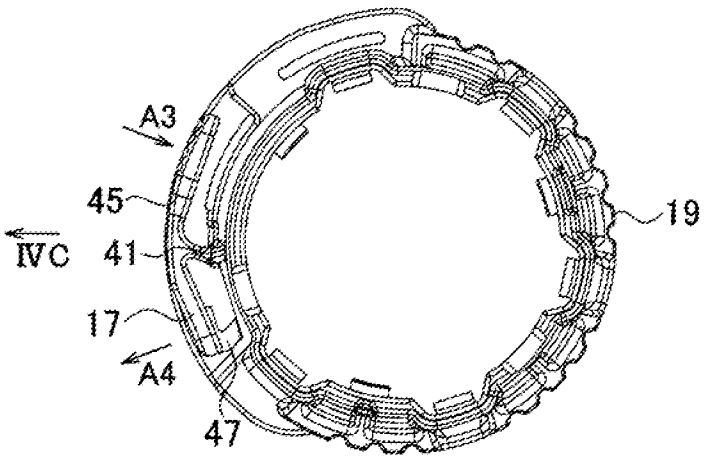
FIG. 4C is a view viewed from the direction of an arrow IVC in FIG. 4A.
Figure 4A:
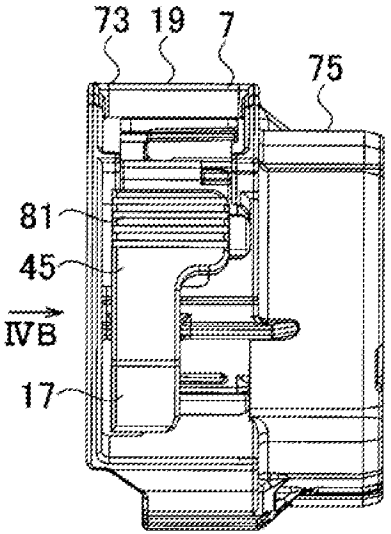
FIG. 4A is a side view of a bayonet ring of the rotary connector according to the first embodiment.
Figure 4B:
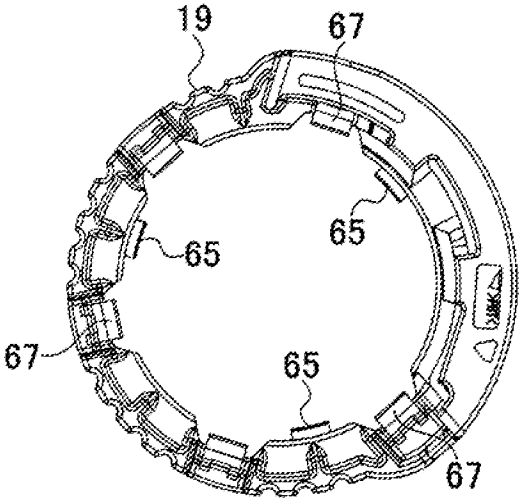
FIG. 4B is a view viewed from the direction of an arrow IVB in FIG. 4A.

The locked portion 17 of the bayonet ring 7 includes an elastic deformation portion 41 that elastically deforms when the locked portion 17 is locked to the locking portion 15 of the first housing 3 or when the locking of the locked portion 17 by the locking portion 15 is released, as illustrated in FIGS. 4A to 4C and the like.

When the locked portion 17 is locked to the locking portion 15 of the first housing 3 or when the locking of the locked portion 17 by the locking portion 15 is released, the elastic deformation portion 41 deforms by a first deformation amount.

When the bonded state is produced and the connector position assurance 9 is located at the second position P2 (in the completely bonded state illustrated in FIG. 10B), the deformation amount of the elastic deformation portion 41 is limited by the first assurance contact portion 27, whereby the state in which the locked portion 17 is locked to the locking portion 15 is maintained.

That is, in the completely bonded state, the elastic deformation portion 41 can deform only by a second deformation amount that is smaller than the first deformation amount by the first assurance contact portion 27, whereby the state in which the locked portion 17 is locked to the locking portion 15 cannot be released.

When the locked portion 17 is locked to the locking portion 15 or when the locking of the locked portion 17 by the locking portion 15 is released, the elastic deformation portion 41 is restored and becomes in an undeformed state.

The locking portion 15 of the first housing 3 is made of a locking projection 43 (see FIG. 6 and the like) provided in the first housing 3 (first housing main body 11).

As illustrated in FIGS. 4A to 4C and the like, the locked portion 17 of the bayonet ring 7 includes the elastic deformation portion 41, an arc-shaped locked portion main body 45, and a locked projection 47 provided in the locked portion main body 45. With the locked projection 47 contacting the locking projection 43, the locked portion 17 is locked to the locking portion 15.

The elastic deformation portion 41 of the bayonet ring 7 projects from the cylindrical bayonet ring main body 19 of the bayonet ring 7, and the locked portion main body 45 of the bayonet ring 7 is formed in an arc shape extending along the arc of the bayonet ring main body 19, and the middle portion of this arc is bonded to the tip portion of the elastic deformation portion 41.

When the connector position assurance 9 is located at the second position P2, the first assurance contact portion 27 of the connector position assurance 9 enters between the first housing 3 and the locked portion main body 45 of the bayonet ring 7, as illustrated in FIG. 10B, whereby the elastic deformation portion 41 is prevented from deforming by a larger amount than the second deformation amount.

That is, the elastic deformation portion 41 can deform only by a gap dimension L3 illustrated in FIG. 10B.

Herein, the rotary connector 1 will be described in more detail.

As illustrated in FIG. 6, the first housing 3 includes a flange portion 49 and a terminal housing portion 51 that is fixed after the plurality of female terminals and cables extending from the female terminals are housed, in addition to the first housing main body 11, the locking portion 15, the arc-shaped groove 33, and the non-grooved portion 35 that have been described above.

The first housing main body 11 is formed in a thick cylindrical shape, and the central axis of the cylinder extends in the front-rear direction. The flange portion 49 is formed in a disc shape, and is provided at the rear end of the first housing main body 11 by being arranged coaxially with the first housing main body 11. The terminal housing portion 51 is provided inside the first housing main body 11. As for the cables with terminals (not illustrated) fixed in the terminal housing portion 51, the terminals are located on the rear side of the terminal housing portion 51, and the cables extend toward the front of the terminal housing portion 51.

The arc-shaped groove 33 and the non-grooved portion 35 are formed in the outer circumference of the first housing main body 11 at the rear side of the first housing main body 11, and the center of the arc of the groove 33 is located on the central axis of the first housing main body 11.

The locking portion 15 (locking projection 43) is provided on the outer circumference of the first housing main body 11 on the front side of the first housing main body 11 (between the flange portion 49 and the arc-shaped groove 33 in the front-rear direction).

An annular first recess 53 is provided in the first housing 3 (first housing main body 11). The first recess 53 is provided between the locking portion 15 (locking projection 43) and the arc-shaped groove 33 in the front-rear direction.

As illustrated in FIGS. 2 and 3, the second housing 5 includes a terminal housing portion 55 and a spiral groove-shaped portion 57, in addition to the second housing main body 13.

The second housing main body 13 is formed in a thick cylindrical shape, and the central axis of the cylinder extends in the front-rear direction. The terminal housing portion 55 is provided inside the second housing main body 13. As for the cables with terminals (not illustrated) fixed in the terminal housing portion 55, the terminals are located on the front side of the terminal housing portion 55, and the cables extend toward the rear of the terminal housing portion 55.

When viewed in the direction (front-rear direction) in which the central axis of the second housing main body 13 extends, each groove-shaped portion 57 is located at the arc of a sector whose central angle centered on the central axis is a predetermined angle, for example, approximately 120 degrees.

Multiple (e.g., three) groove-shaped portions 57 are provided, and when viewed in the front-rear direction, the respective groove-shaped portions 57 are arranged at positions where the circle of the second housing main body 13 is equally divided (e.g., equally divided into three pieces).

Each groove-shaped portion 57 is made of a first groove-shaped part 59, a second groove-shaped part 61, and a third groove-shaped part 63. The depth dimensions and width dimensions of the respective groove-shaped parts 59, 61, 63 are the same as each other.

When each groove-shaped portion 57 is viewed in a predetermined direction perpendicular to the front-rear direction, the first groove-shaped part 59 extends by a slightly short length from the front end of the second housing main body 13 toward the rear, as illustrated in FIG. 3. The second groove-shaped part 61 extends by a predetermined length from the rear end of the first groove-shaped part 59 obliquely with respect to the front-rear direction. The third groove-shaped part 63 extends by a predetermined length (a predetermined length longer than the first groove-shaped part 59 and shorter than the second groove-shaped part 61) from the rear end of the second groove-shaped part 61 in the direction perpendicular to the front-rear direction.

As illustrated in FIGS. 4A to 4C and 5, the bayonet ring 7 includes engagement projections 65 and engagement convex portions 67, in addition to the bayonet ring main body 19, the locked portion 17, the contact portion 25 (bayonet ring contact portion 39), and the connector position assurance support portion 37.

The bayonet ring main body 19 includes a front side part 73 and a rear side part 75. The front side part 73 is formed in a cylindrical shape with a rib 69 projecting inside. The inner diameter of the bayonet ring main body 19 (front side part 73, rear side part 75) is substantially equal to or slightly larger than the outer diameter of the first housing main body 11 and the outer diameter of the second housing main body 13. Herein, the inner diameter of the front side part 73 of the bayonet ring main body 19 means the diameter of an envelope circle formed at the tip of the rib 69, when viewed in the front-rear direction.

Figure 5:
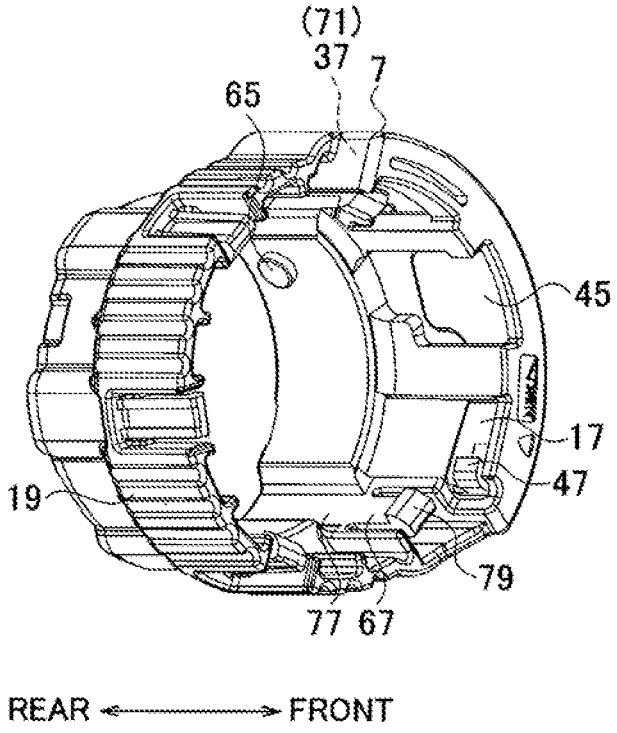
FIG. 5 is a perspective view of the bayonet ring of the rotary connector according to the first embodiment.

As illustrated in FIG. 5, the connector position assurance support portion 37 is made of a second recess 71 that is recessed inward from the outer circumferential portion of the bayonet ring main body 19. The second recess 71 is formed in part of the front side part 73 of the bayonet ring main body 19 in the circumferential direction of the cylindrical bayonet ring main body 19, and is formed in the center of the front side part 73 in the front-rear direction.

Figure 8:
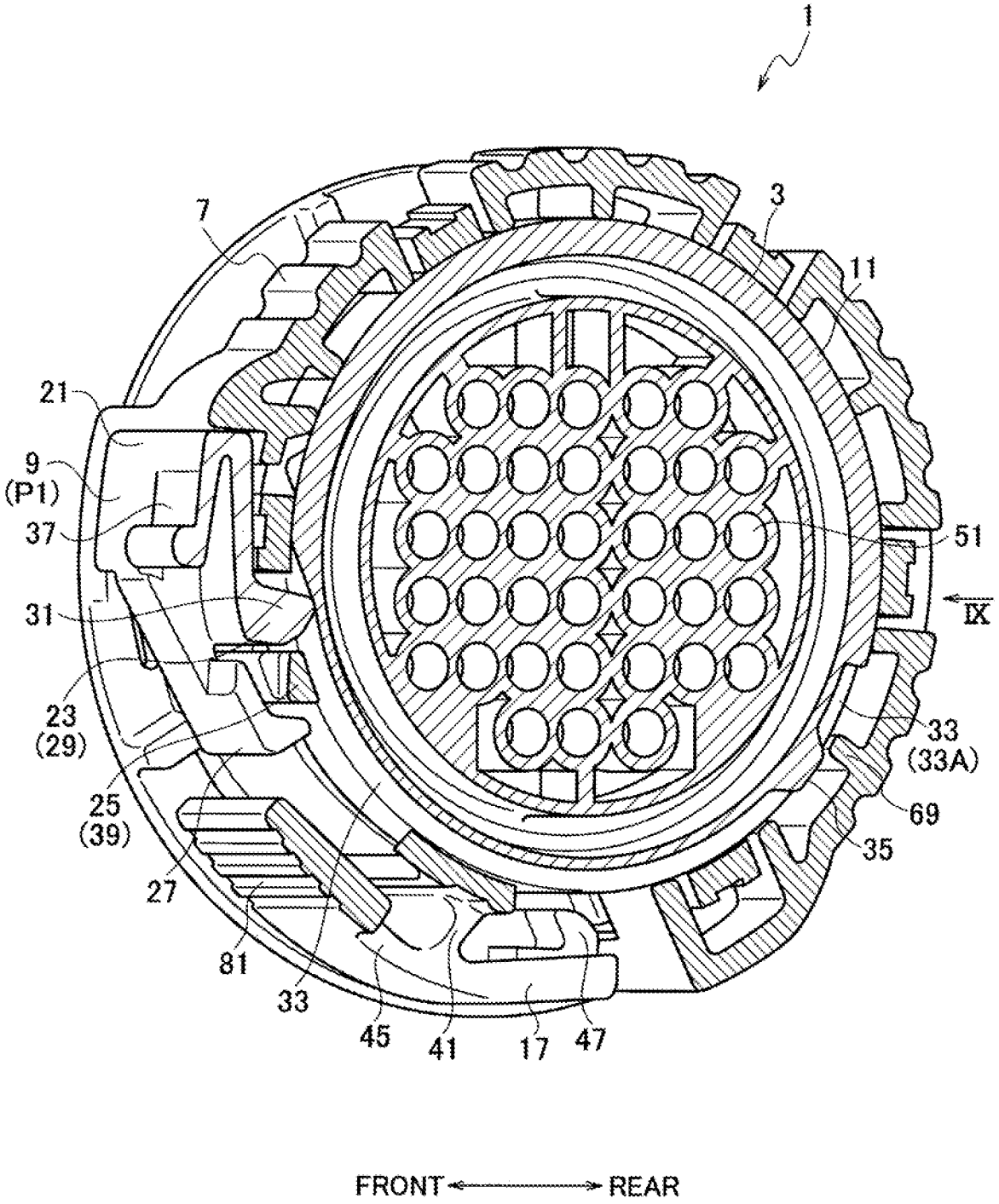
FIG. 8 is a cross-sectional perspective view of the rotary connector according to the first embodiment, illustrating a state in which the connector position assurance is located at a first position in a ready state.
Figure 9:
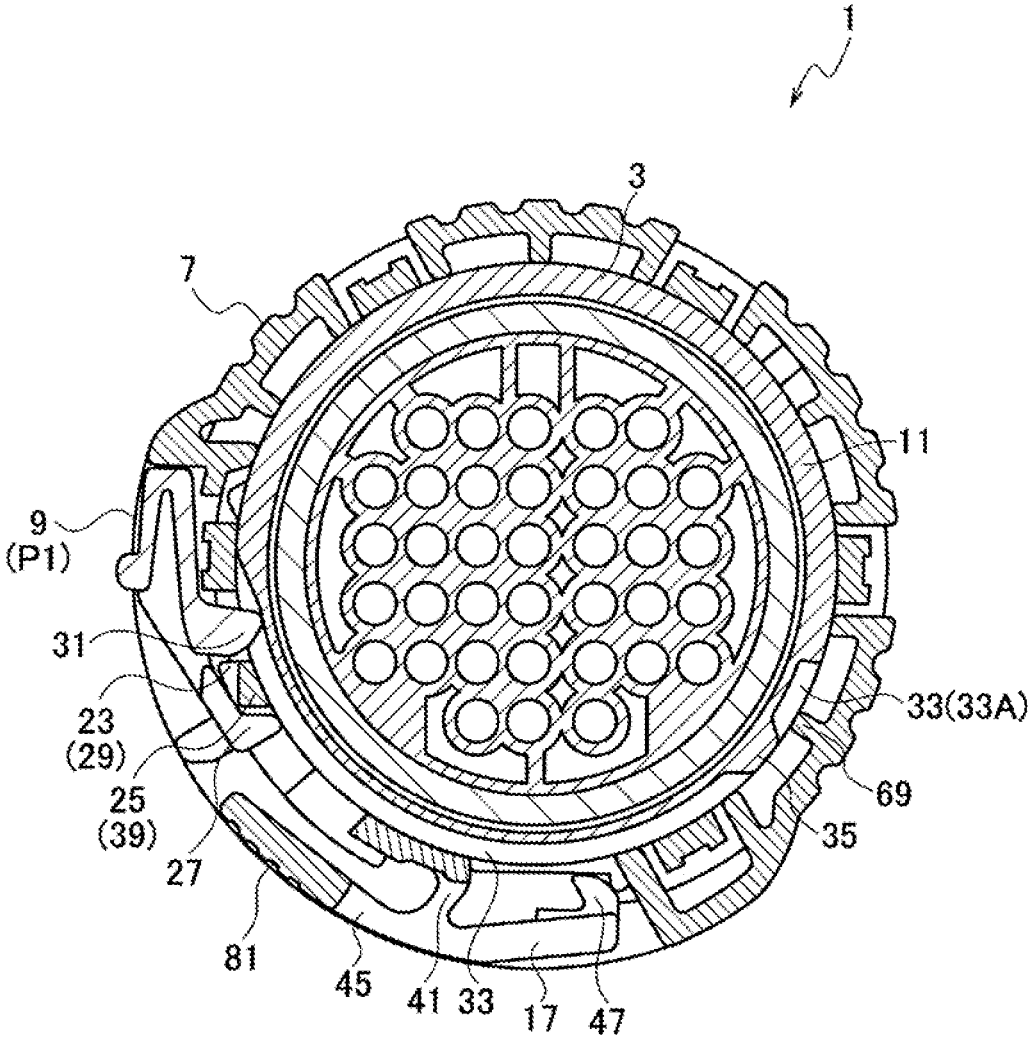
FIG. 9 is a view viewed from the direction of an arrow IX in FIG. 8.

As illustrated in FIGS. 8 and 9, the contact portion 25 (bayonet ring contact portion 39) is made of a part of the rib 69.

The locked portion 17 is provided near the second recess 71 in the circumferential direction of the front side part 73 of the cylindrical bayonet ring main body 19, and includes the elastic deformation portion 41, the locked portion main body 45, and the locked projection 47, as illustrated in FIG. 4C.

When viewed in the front-rear direction, the locked portion main body 45 is formed in a short arc shape, and the elastic deformation portion 41 is located in the middle of the arc. The locked projection 47 is provided at one end of the arc of the locked portion main body 45.

When the other end (operation unit) 81 of the arc of the locked portion main body 45 is pushed inward as indicated by an arrow A3 in FIG. 4C, the elastic deformation portion 41 mainly deforms elastically, and the locked projection 47 moves outward as indicated by an arrow A4 in FIG. 4C, whereby the locked portion 17 of the bayonet ring 7, locked to the locking portion 15 of the first housing 3, moves away from the locking portion 15.

So, the bayonet ring 7 can rotate in the direction indicated by an arrow A5 in FIG. 10A with respect to the first housing 3 and the second housing 5, and the bonded state between the first housing 3 and the second housing 5 can be released.

Each engagement projection 65 is formed, on the rear side of the bayonet ring main body 19, in a short cylindrical shape that slightly projects from the inner wall of the bayonet ring main body 19 toward the center. The outer diameter of each cylindrical engagement projection 65 is equal to or slightly smaller than the width dimension of each groove-shaped portion 57. The height dimension of the cylindrical engagement projection 65 is smaller than the depth dimension of each groove-shaped portion 57.

The engagement projections 65, the number of which is the same as the number of the spiral groove-shaped portions 57 of the second housing 5, are provided. In the ready state and bonded state, each engagement projection 65 enters the corresponding groove-shaped portion 57.

Each engagement convex portion 67 includes an elastic arm portion 77 and a projection 79. The elastic arm portion 77 extends, near the inner wall of the bayonet ring main body 19, in the front-rear direction along the bayonet ring main body 19, and the base end portion (rear end portion) of the elastic arm portion 77 is bonded to the bayonet ring main body 19.

The projection 79 slightly projects from the tip of the elastic arm portion 77 toward the center of the bayonet ring main body 19. Multiple (e.g., three) engagement convex portions 67 are provided, and when viewed in the front-rear direction, the engagement convex portions 67 are arranged at positions where the circle of the bayonet ring main body 19 is equally divided (e.g., equally divided into three pieces).

In the ready state and the bonded state, each projection 79 of the bayonet ring 7 enters the annular first recess 53 of the first housing 3, and each engagement projection 65 of the bayonet ring 7 enters the corresponding groove-shaped portion 57 of the second housing 5.

When the bayonet ring 7 is rotated to one side with respect to the first housing 3 in the ready state, the bonded state is produced, and when the bayonet ring 7 is rotated to the other side with respect to the first housing 3 in the bonded state, the ready state is produced.

Herein, each engagement projection 65 enters the corresponding second groove-shaped part 61 (front end portion of the second groove-shaped part 61 of the corresponding groove-shaped portion 57 of the second housing 5) in the ready state, and each engagement projection 65 enters the corresponding third groove-shaped part 63 in the bonded state.

As illustrated in FIGS. 2 and 7A to 7C, the connector position assurance 9 includes an operation unit 83 and a pair of projections 85, in addition to the assurance main body 21, the first assurance contact portion 27, the contacted portion 23 (second assurance contact portion 29), and the assurance projected portion 31.

When the connector position assurance 9 is located at the first position P1 to produce the ready state, the assurance projected portion 31, provided in the second assurance contact portion 29 of the connector position assurance 9, enters the arc-shaped groove 33 provided in the first housing 3, and the contacted portion 23 of the connector position assurance 9 contacts the contact portion 25 of the bayonet ring 7, as illustrated in FIGS. 8, 9, and 11. This contacting prevents the connector position assurance 9 from moving from the first position P1 to the second position P2.

When the connector position assurance 9 is located at the first position P1 in the bonded state, the locked portion 17 of the bayonet ring 7 is locked to the locking portion 15 of the first housing 3, and the assurance projected portion 31 of the connector position assurance 9 contacts or is located near the non-grooved portion 35, as illustrated in FIG. 10A.

When the connector position assurance 9 is moving from the first position P1 to the second position in the bonded state, the locked portion 17 of the bayonet ring 7 is locked to the locking portion 15 of the first housing 3 and the assurance projected portion 31 of the connector position assurance 9 rides on the non-grooved portion 35, whereby a situation is produced in which the contacted portion 23 of the connector position assurance 9 does not contact the contact portion 25 of the bayonet ring 7.

In a state (completely bonded state) in which the connector position assurance 9 finishes moving from the first position P1 to the second position P2 in the bonded state, the locked portion 17 of the bayonet ring 7 is locked to the locking portion 15 of the first housing 3 and the assurance projected portion 31 of the connector position assurance 9 rides over the non-grooved portion 35 to be located in the arc-shaped groove 33 (33A), as illustrated in FIG. 10B. This prevents the connector position assurance 9 located at the second position P2 from easily moving toward the first position P1.

Further, in the completely bonded state, the first assurance contact portion 27 enters between the first housing 3 and one end portion of the locked portion main body 45 constituting the locked portion 17 of the connector position assurance 9, and the elastic deformation amount of the elastic deformation portion 41 of the locked portion 17 is reduced, whereby the locked portion 17 is prevented from being detached from the locking portion 15.

Additionally, the rotary connector 1 includes a front holder 87 and a packing 89, as illustrated in FIG. 2, and in the bonded state, the front holder 87 and the packing 89 are also integrated with the first housing 3, the second housing 5, and the bayonet ring 7.

Next, the bonding operations of the rotary connector 1 from the ready state to the completely bonded state through the bonded state will be described.

First, in the ready state, the bayonet ring 7 is rotated in the direction indicated by the arrow A1 in FIG. 1 with respect to the first housing 3, whereby the bonded state is produced. At this time (in a ready and bonded stage), the bayonet ring 7 only rotates around the central axis of the first housing 3 with respect to the first housing 3, without moving in the front-rear direction. On the other hand, the second housing 5 approaches the first housing 3 by moving forward, without rotating around the central axis of the first housing 3 or the second housing 5.

Additionally, in the ready and bonded stage, the assurance projected portion 31 of the connector position assurance 9 moves in the arc-shaped groove 33 of the first housing 3, while the contacted portion 23 of the connector position assurance 9 is contacting the contact portion 25 of the bayonet ring 7.

At around the end of the ready and bonded stage, the locked projection 47 constituting the locked portion 17 of the bayonet ring 7 contacts the locking projection 43 constituting the locking portion 15 of the first housing 3, and the elastic deformation portion 41 of the locked portion 17 elastically deforms, whereby the locked projection 47 rides over the locking projection 43 to produce the bonded state.

In the bonded state, the locked portion 17 of the bayonet ring 7 is locked to the locking portion 15 of the first housing 3, and the assurance projected portion 31 contacts the non-grooved portion 35, as illustrated in FIG. 10A.

In the bonded state, the connector position assurance 9 located at the first position P1 is moved to the second position P2 with respect to the bayonet ring 7. At this time, the assurance projected portion 31 rides over the non-grooved portion 35, so the contacted portion 23 (second assurance contact portion 29) of the connector position assurance 9 is detached from the contact portion 25 (bayonet ring contact portion 39) of the bayonet ring 7, whereby the connector position assurance 9 can move to the second position P2.

With the connector position assurance 9 moving to the second position P2, the completely bonded state is produced. In the completely bonded state, the assurance projected portion 31 enters the arc-shaped groove 33A, and the first assurance contact portion 27 of the connector position assurance 9 enters the inside of the locked portion main body 45 constituting the locked portion 17 of the bayonet ring 7, as illustrated in FIG. 10B, whereby the elastic deformation of the elastic deformation portion 41 is suppressed.

The separation operations of the rotary connector 1 from the completely bonded state to the ready state through the bonded state are performed through procedures reverse to the bonding operations. When a transition from the bonded state to the ready state is to be made, one end portion of the locked portion main body 45 (operation unit 81 opposite to the locked projection 47) is pushed in the direction indicated by an arrow A7 (arrow A3 in FIG. 4C), and the other end of the locked portion main body 45 is lifted in the direction indicated by an arrow A8 (arrow A4 in FIG. 4C), as illustrated in FIG. 10A.

In the rotary connector 1, the contacted portion 23 of the connector position assurance 9 contacts the contact portion 25 of the bayonet ring 7 in the ready state, whereby the connector position assurance 9 is prevented from moving from the first position P1. In the bonded state, the connector position assurance 9 can move from the first position P1 to the second position P2, and when the connector position assurance 9 finishes moving to the second position P2, a state in which the locked portions 17 of the bayonet ring 7 is locked to the locking portions 15 of the first housing 3 is maintained (assured). Thereby, the condition in which the connector position assurance 9 operates can be limited to when the bayonet ring 7 is rotated so that a state (bonded state) in which the bonding is performed is produced, whereby the bonded state between the second housing 5 and the first housing 3 by the connector position assurance 9 can be assured.

In the rotary connector 1, the assurance projected portion 31 enters the arc-shaped groove 33 of the first housing 3 and the second assurance contact portion 29 contacts the bayonet ring contact portion 39 in the ready state, whereby the connector position assurance 9 is prevented from moving from the first position P1 to the second position P2. In the bonded state, the assurance projected portion 31 contacts the non-grooved portion 35, so a situation in which the second assurance contact portion 29 does not contact the bayonet ring contact portion 39 is produced, whereby the connector position assurance 9 can move from the first position P1 to the second position P2. Additionally, the non-grooved portion 35 is formed by being interrupted by only a slight length at one end in the direction in which the arc of the arc-shaped groove 33 of the first housing 3 extends.

Thereby, the configuration of the first housing 3 that engages with the assurance projected portion 31 of the connector position assurance 9 can be simplified.

According to the rotary connector 1, when the connector position assurance 9 is located at the second position P2 in the bonded state (when the completely bonded state is produced), the deformation amount of the elastic deformation portion 41 constituting the locked portion 17 of the bayonet ring 7 is limited by the first assurance contact portion 27, and the state in which the locked portion 17 of the bayonet ring 7 is locked to the locking portion 15 of the first housing 3 is maintained, whereby the state in which the locked portion 17 of the bayonet ring 7 is locked to the locking portion 15 of the first housing 3 is accurately maintained.

In the rotary connector 1, the elastic deformation portion 41 of the locked portion 17 of the bayonet ring 7 projects from the cylindrical bayonet ring main body 19; the locked portion main body 45 of the locked portion 17 of the bayonet ring 7 is formed in an arc shape along the arc of the bayonet ring main body 19; and the middle portion of the arc is bonded to the tip of the elastic deformation portion 41. When the connector position assurance 9 is located at the second position P2, the first assurance contact portion 27 enters between the first housing 3 and the locked portion main body 45, whereby the elastic deformation portion 41 is prevented from deforming.

Thereby, when the completely bonded state is produced, the posture of the locked portion main body 45 (locked portion main body 45 sandwiching the first assurance contact portion 27 of the connector position assurance 9 in cooperation with the first housing 3) that is provided with the locked portion 17 and supported by the elastic deformation portion 41 can be surely maintained, whereby the state in which the locked portion 17 of the bayonet ring 7 is locked to the locking portion 15 of the first housing 3 can be surely maintained.

Second Embodiment

A rotary connector 1*a* according to a second embodiment will be described with reference to FIGS. 12A to 12C, 13A, and 13B.

The rotary connector 1*a* according to the second embodiment is different from the rotary connector 1 according to the first embodiment in the form of a first assurance contact portion 27*a* of a connector position assurance 9*a*, but the other portions are configured in substantially the same manner as those of the rotary connector 1 according to the first embodiment, and has substantially the same effects.

That is, in the rotary connector 1*a* according to the second embodiment, the first assurance contact portion 27*a* contacts the locked portion 17 even when the connector position assurance 9*a* is located at the first position P1 (see FIG. 13A), whereby the elastic deformation portion 41 is prevented from excessively deforming.

By preventing excessive deformation, the elastic deformation portion 41 does not deform by more than a third deformation amount (smaller than the first deformation amount and equal to or slightly different from the second deformation amount).

In further description, in the rotary connector 1 according to the first embodiment, there is a gap between the locked portion main body 45 and the first housing main body 11, the dimension of the gap being L1, as seen in the ready state and the bonded state illustrated in FIG. 10A.

Figure 13A:
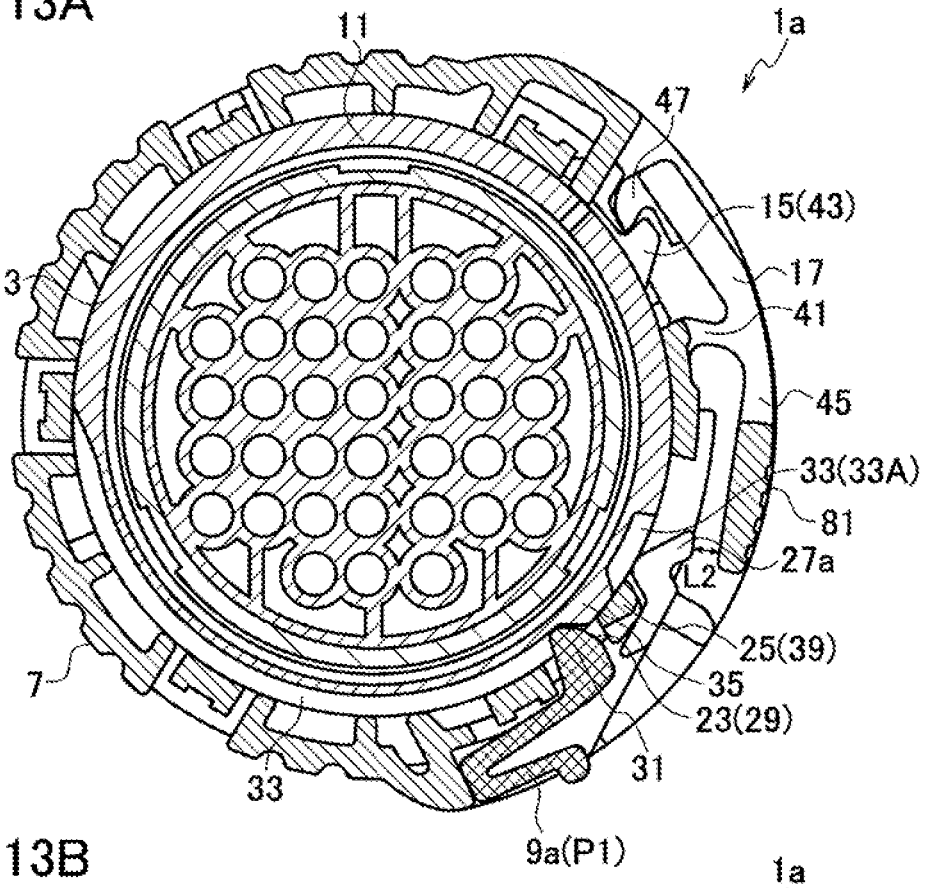
FIG. 13A is a cross-sectional view illustrating a state in which the connector position assurance of the rotary connector according to the second embodiment is located at a first position.

On the other hand, in the rotary connector 1*a* according to the second embodiment, the first assurance contact portion 27*a* enters between the locked portion main body 45 and the first housing main body 11, and hence there is a gap between the locked portion main body 45 and the first assurance contact portion 27*a*, the dimension of the gap being only L2 (L2<L1), as seen in the ready state and the bonded state illustrated in FIG. 13A. This prevents the elastic deformation portion 41 from excessively deforming.

Figure 13B:
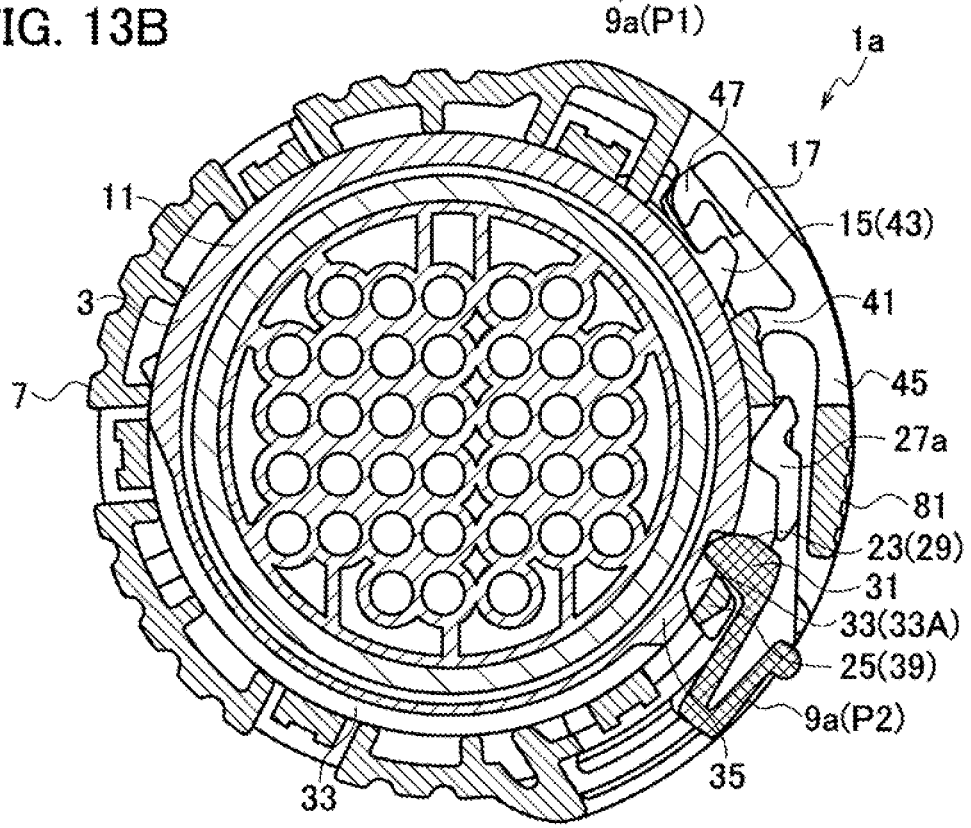
FIG. 13B is a cross-sectional view illustrating a state (completely bonded state) in which the connector position assurance of the rotary connector according to the second embodiment is located at a second position.

In the completely bonded state, the deformation amount of the elastic deformation portion 41 of the locking portion 15 is reduced similarly to the rotary connector 1 according to the first embodiment, as illustrated in FIG. 13B, whereby the state in which the locked portion 17 of the bayonet ring 7 is locked to the locking portion 15 of the first housing 3 is maintained.

According to the rotary connector 1*a* of the second embodiment, the first assurance contact portion 27*a* of the connector position assurance 9*a* contacts the locked portion 17 of the bayonet ring 7 even when the connector position assurance 9*a* is located at the first position P1, whereby the elastic deformation portion of the locked portion 17 of the bayonet ring 7 is prevented from excessively deforming; and hence the elastic deformation portion 41 of the locked portion 17 of the bayonet ring 7 is prevented from excessively deforming, regardless of the position of the connector position assurance 9*a* with respect to the bayonet ring 7, whereby the durability of the locked portion 17 of the bayonet ring 7 can be secured, and damages etc., of the locked portion 17 of the bayonet ring 7 can be prevented.

Each of the above rotary connectors 1, 1*a* is an examples of a rotary connector including a first housing 3, a second housing 5, a bayonet ring 7, and a connector position assurance 9, 9*a*, in which: by rotating the bayonet ring 7 engaging with the first housing 3 and the second housing 5, the first housing 3 and the second housing 5 are bonded together; in a ready state before the first housing 3 and the second housing 5 are bonded together, the connector position assurance 9, 9*a* engaging with the bayonet ring 7 is prevented from moving; in a bonded state in which the second housing 5 is bonded to the first housing 3, the connector position assurance 9, 9*a* engaging with the bayonet ring 7 can move; and by moving the connector position assurance 9, 9*a* engaging with the bayonet ring 7 in the bonded state in which the second housing 5 is bonded to the first housing 3, the state in which the second housing 5 is bonded to the first housing 3 is maintained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary connector, comprising:

a first housing;

a second housing that is fixed to the first housing;

a locking portion formed in at least one of the first housing and the second housing;

a bayonet ring comprising a locked portion to be locked to the locking portion, the bayonet ring configured to form, in a ready state of engaging with the first housing and the second housing, a bonded state in which the second housing is bonded to the first housing by rotating by a predetermined angle with respect to the first housing, and configured to be prevented, in the bonded state, from rotating with respect to the first housing with the locked portion locked to the locking portion;

a contact portion formed on the bayonet ring; and a connector position assurance comprising a contacted portion to contact the contact portion, and capable of engaging with the bayonet ring, in the ready state, the connector position assurance located at a first position and prevented from moving from the first position with the contacted portion contacting the contact portion, in the bonded state, the connector position assurance capable of moving from the first position to a second position with the contacted portion moving away from the contact portion, and when being located at the second position, the connector position assurance maintaining the state in which the locked portion is locked to the locking portion wherein:

the connector position assurance comprises an assurance main body, a first assurance contact part projecting from the assurance main body, a second assurance contact part projecting from the assurance main body and constituting the contacted portion, and an assurance projected portion projecting from and at a tip of the second assurance contact part;

the first housing is formed in a cylindrical shape;

in a side surface of the first housing, an arc-shaped groove extending by a predetermined length in a circumferential direction of the side surface is provided;

the arc-shaped groove is interrupted at one end in its longitudinal direction, the interrupted portion constituting a non-grooved portion;

the bayonet ring is formed in an annular shape, and engages with the first housing such that the first housing enters inside;

the bayonet ring comprises a connector position assurance support portion that supports the connector position assurance such that the connector position assurance moves in a circumferential direction of the bayonet ring with the assurance main body engaging, and a bayonet ring contact portion that constitutes the contact portion and that the second assurance contact part contacts;

in the ready state, the assurance projected portion enters the arc-shaped groove and the second assurance contact part contacts the bayonet ring contact portion, whereby the connector position assurance is prevented from moving from the first position; and in the bonded state, the assurance projected portion contacts the non-grooved portion, so that the second assurance contact part is in a state of not contacting the bayonet ring contact portion and the connector position assurance is moveable from the first position to the second position, and since the connector position assurance is located at the second position, the first assurance contact part engages with the locked portion, whereby the state in which the locked portion is locked to the locking portion is maintained.

2. The rotary connector of claim 1, wherein:

the locked portion comprised an elastic deformation portion that elastically deforms when being locked to the locking portion; and when the connector position assurance is located at the second position in the bonded state, a deformation amount of the elastic deformation portion is limited by the first assurance contact part, whereby the state in which the locked portion is locked to the locking portion is maintained.

3. The rotary connector of claim 2, wherein in a state in which the connector position assurance is located at the first position, the first assurance contact part contacts the locked portion, whereby the elastic deformation portion is prevented from excessively deforming.

4. The rotary connector of claim 2, wherein:

the locking portion is made of a locking projection provided in the first housing;

the locked portion comprises the elastic deformation portion, an arc-shaped locked portion main body, and a locked projection provided in the locked portion main body;

the locked portion is locked to the locking portion with the locked projection contacting the locking projection;

the elastic deformation portion projects from a cylindrical bayonet ring main body of the bayonet ring;

the locked portion main body is formed in an arc shape extending along an arc of the bayonet ring main body;

a middle portion of the arc of the bayonet ring main body is bonded to a tip of the elastic deformation portion; and when the connector position assurance is located at the second position, the first assurance contact part enters between the bayonet ring and the locked portion main body, whereby the elastic deformation portion is prevented from deforming.

5. The rotary connector of claim 3, wherein:

the locking portion is made of a locking projection provided in the first housing;

the locked portion comprises the elastic deformation portion, an arc-shaped locked portion main body, and a locked projection provided in the locked portion main body;

the locked portion is locked to the locking portion with the locked projection contacting the locking projection;

the elastic deformation portion projects from a cylindrical bayonet ring main body of the bayonet ring;

the locked portion main body is formed in an arc shape extending along an arc of the bayonet ring main body;

a middle portion of the arc of the bayonet ring main body is bonded to a tip of the elastic deformation portion; and when the connector position assurance is located at the second position, the first assurance contact part enters between the bayonet ring and the locked portion main body, whereby the elastic deformation portion is prevented from deforming.

* * * * *